US006922898B2

(12) United States Patent
Douillard et al.

(10) Patent No.: US 6,922,898 B2
(45) Date of Patent: Aug. 2, 2005

(54) DRYWALL BEAD PRESS

(75) Inventors: Gerald Albert Douillard, 2685 Kentshire Way, Lawrenceville, GA (US) 30044; Matthew Biff Gotchy, Reno, NV (US); Thomas Mark Harding, Sun Valley, NV (US)

(73) Assignee: Gerald Albert Douillard, Lawrenceville, GA (US)

( * ) Notice: Subject to any disclaimer, the term of this patent is extended or adjusted under 35 U.S.C. 154(b) by 0 days.

(21) Appl. No.: 10/461,656

(22) Filed: Jun. 13, 2003

(65) Prior Publication Data

US 2003/0229990 A1 Dec. 18, 2003

Related U.S. Application Data

(60) Provisional application No. 60/388,516, filed on Jun. 13, 2002.

(51) Int. Cl.[7] ..... B26B 13/00; B26B 13/06

(52) U.S. Cl. ..... 30/229; 30/199; 30/243

(58) Field of Search ..... 30/229, 178, 185, 30/243, 177, 199, 175, 182–184, 364, 363

(56) References Cited

U.S. PATENT DOCUMENTS

| | | | | |
|---|---|---|---|---|
| 5,327,652 A | * | 7/1994 | Balback | 30/359 |
| 6,125,546 A | | 10/2000 | Laws et al. | 30/257 |
| 6,282,937 B1 | | 9/2001 | Michaud | 72/178 |
| 6,427,418 B1 | | 8/2002 | Zell | 52/754.05 |

* cited by examiner

*Primary Examiner*—Douglas D Watts
(74) *Attorney, Agent, or Firm*—E. J. Asbury, III, LLC; E. J. Asbury, III

(57) ABSTRACT

A tool for cutting drywall bead that has a shaped cross section and requires cutting to length with both straight and angled cuts. The tool includes a base with a first handle attached thereto and a second handle pivotably attached to the base, and a blade with a cutting edge movably engages the base. An anvil pivotably attaches to the base and may be rotated to a chosen angle relative to the blade, and the anvil has a shaped upper surface which complimentarily engages the shaped cross section of the drywall bead. A mechanical linkage forces the cutting edge of the blade towards the anvil when the second handle is biased towards the first handle such that a drywall bead positioned over the anvil is cut at a desired angle.

16 Claims, 5 Drawing Sheets

DRYWALL BEAD PRESS

CROSS-REFERENCE TO RELATED APPLICATION

This application claims the benefit of U.S. Provisional Application Ser. No. 60/388,516, filed on Jun. 13, 2002.

BACKGROUND OF THE INVENTION

1. Field of the Invention

The present invention generally relates to hand tools used in the building construction art. More particularly, the present invention relates to a drywall bead press used to make precise and consistent straight and angular cuts to drywall bead.

2. Description of the Related Art

Modern framing and drywall often includes corner bead material. The product is widely used to create round and otherwise finished corners. A number of obstacles face a construction worker in the installation of drywall corner bead. Traditional hand snips utilized in the construction industry are imprecise. For example, an angled cut must be made to match two opposing pieces of drywall bead material in a doorframe corner. The precision of the cut is important to ensure that drywall tape and mud can be applied to a smooth base, thereby ensuring a smooth and continuous surface in the finished wall. Often, large pieces of drywall bead material must be discarded following a less than perfect cut using hand snips.

Another problem is the contoured cross-sectional shape of the drywall bead. If traditional hand snips are used to cut the material, the straight cutting action of the snips crushes and distorts the contoured cross-section at the cut location. At a corner where both opposing pieces of drywall bead must be cut, the damaged cross-sectional shape of the adjoining pieces may easily result in a blemish in the finished surface. To compound the problem, modern architectural design often calls for walls and other interior surfaces that intersect at odd angles. In this situation, construction workers often apply a cut and fit approach which is both inefficient and often produces less than satisfactory results.

Accordingly it would be advantageous to provide a tool that eliminates the imprecision of hand-eye gauged drywall bead cutting that increases the precision of drywall bead cuts by controlling the angle of the cut, that does not distort the drywall bead cross-section and that helps to eliminate the disposal of costly construction materials. It is thus to such a drywall bead press and method that the present invention is primarily directed.

SUMMARY OF THE INVENTION

The disadvantages of the prior art are overcome by the present invention which, in one aspect, is a tool for the precise cutting of drywall bead, the drywall bead having a shaped cross section and requiring cutting to length. The tool comprising a base with a first handle attached to the base. A second handle engages the base such that the handle is movable relative to the base. A blade having a cutting edge engages the base and is movable relative the base. An anvil pivotally attaches to the base. The anvil is rotatable to an angle relative to the blade and has a shaped upper surface suitable for complimentarily engaging the shaped cross section of a length of drywall bead. A section of drywall bead to be cut is positioned over the anvil. A mechanical linkage forces the cutting edge of the blade towards the anvil when the second handle is biased towards the first handle such that the drywall bead is cut at an angle. The blade of the tool being readily replaceable when in dulls.

In another aspect, the blade slideably engages the base such that biasing the second handle toward the first handle forces the cutting edge of the blade to move linearly towards the anvil. The mechanical linkage used in the tool is a rack and pawl assembly.

In yet another aspect, the blade pivotably engages the base such that biasing the second handle towards the first handle forces the cutting edge of the blade to rotate toward the anvil. The mechanical linkage used is a scissor linkage.

In yet another aspect, the shaped surface of the anvil has a recessed channel into which the cutting edge of the blade is received when the second handle is biased towards the first handle. The drywall bead is cut at a 45 degree angle across the shaped cross section.

In yet another aspect, the invention provides a tool for the precise cutting of drywall bead, the drywall bead having a shaped cross section and requiring cutting to length. The tool comprising a base with a first handle attached to the base. A second handle engages the base such that the handle is movable relative to the base. A blade having a cutting edge engages the base and is movable relative the base. An anvil pivotally attaches to the base. The anvil is rotatable to an angle relative to the blade and has a shaped upper surface suitable for complimentarily engaging the shaped cross section of a length of drywall bead. A section of drywall bead to be cut is positioned over the anvil. The invention includes a means for forcing the cutting edge of the blade towards the anvil when the second handle is biased towards the first handle such that the drywall bead is cut at an angle.

The invention further provides a method for cutting drywall bead at an angle. The drywall bead has a shaped cross section and requires cutting to length. The method includes the steps of placing the anvil of a cutting device onto a section of drywall bead. The anvil has a shaped surface thereon suitable for complimentarily engaging the shaped cross section of the drywall bead. The anvil is pivotally attached to a base of the device such that the anvil may be rotated to a chosen angle relative to the base. The base further having a first handle rigidly attached thereto and a second handle engaged therewith such that the second handle may move relative to the base. The device further having a blade movably engaged with the base and including a cutting edge. A mechanical linkage is between the second handle and the blade such that operation of the second handle forces the cutting edge of the blade towards the anvil. The section of drywall bead is then cut at an angle by biasing the second handle towards the first handle.

DETAILED DESCRIPTION OF THE INVENTION

Figure 1:
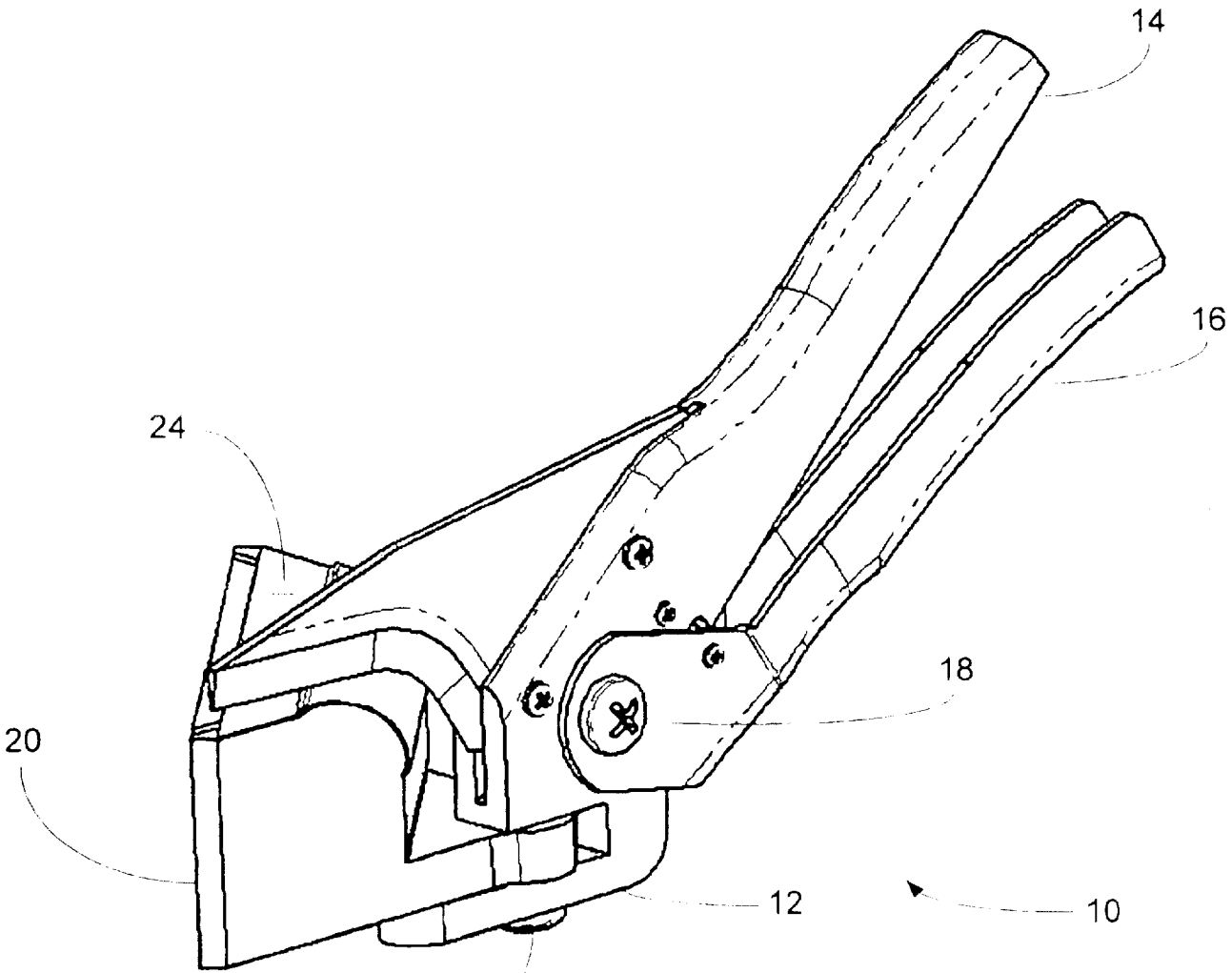
FIG. 1 is a side-perspective view of the drywall bead press.
Figure 2:
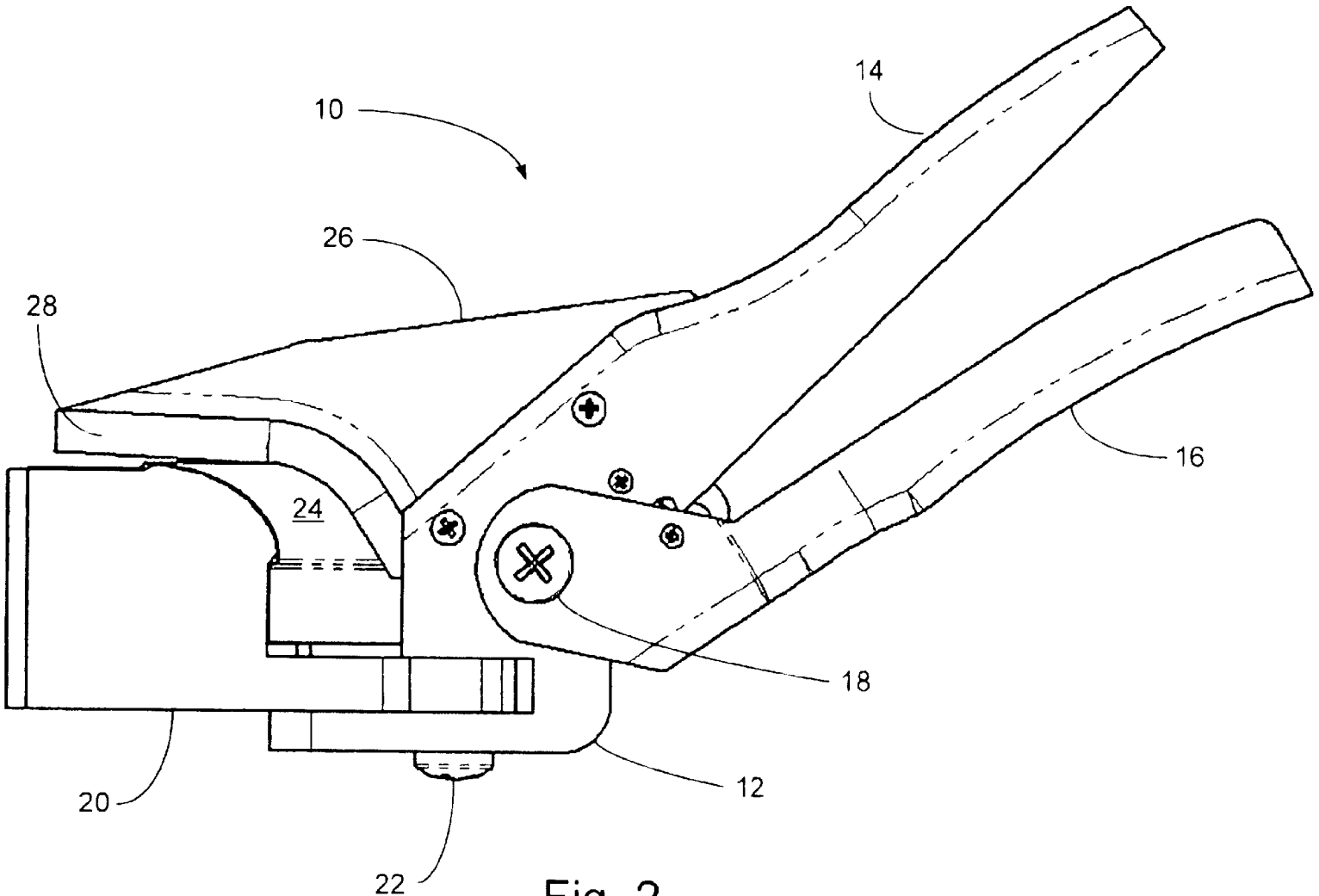
FIG. 2 is a side-elevation view of the tool of FIG. 1.

With reference to the figures in which like numerals represent like elements throughout, FIG. 1 is a side perspective view of one embodiment of the drywall bead press 10. As shown in FIG. 1, the drywall bead press 10 includes a fixed handle 14 connected to a base 12. A pivoting handle 16 is also connected to base 12 by screw 18. An anvil 20 is connected to the base 12 by screw 22 and may rotate relative to the base 12. The drywall bead to be cut is positioned upon the shaped upper surface 24 of the anvil 20. FIG. 2 is a side elevation of the drywall bead press. As shown in FIG. 2, the drywall bead press 10 includes a blade 26 with a sharpened edge 28. A reference plane of the anvil 20 is defined as including the centerline of screw 22 and passing through the centroid of the anvil 20. The angle formed between the plane of the blade 26 and the reference plane of the anvil 20 determines the angle at which the drywall bead will be cut.

Figure 3:
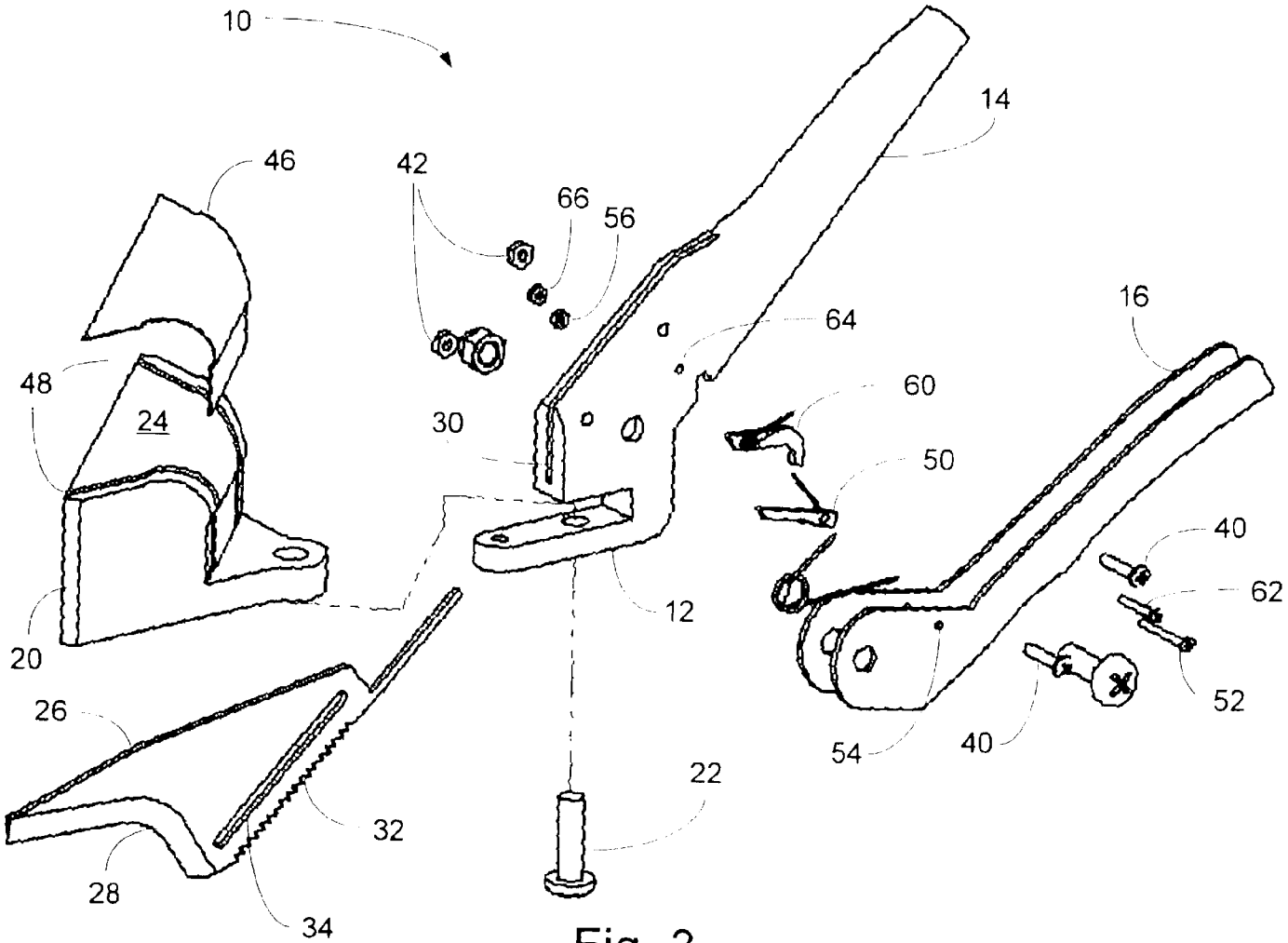
FIG. 3 is an exploded view of the apparatus of FIG. 1, illustrating the tool assembly including the rack and pawl mechanism, stop pawl and springs.

FIG. 3 is an exploded view of the drywall bead press 10. As shown in FIG. 3, the fixed handle 14 and base 12 may be combined into a single component. In an alternative embodiment, the fixed handle 14 may be a separate component and attached to the base 12. The base 12 includes a guide channel 30 into which the blade 26 is inserted. The blade 26 has a toothed edge 32 and a slot 34 running parallel to the toothed edge 32. During assembly, the blade 26 is inserted into guide channel 30 and retained in the base 12 by stabilizer screws 40. The stabilizer screws 40 pass through the base 12 and engage the blade 26 by passing through slot 34. The stabilizer screws 40 are secured in position by nuts 42. The blade 26 is readily replaceable if it becomes dulled with use, by removing stabilizer screws 40, removing the old blade 26 and inserting a new blade 26, and reinstalling stabilizer screws 40.

As further shown in FIG. 3, the anvil 20 has a shaped upper surface 24. A portion of drywall bead 46 is shown above the shaped upper surface 24 of the anvil 20. The shaped upper surface 24 matches the contour of the drywall bead 46. The sharpened edge 28 of the blade 26 also substantially matches the contours of the drywall bead. In operation, the shaped upper surface 24 supports the drywall bead 46 as it is cut by blade 26. The shaped upper surface 24 thus prevents crushing or distortion of the drywall bead 46 as it is cut. The anvil 20 also includes shallow recessed channels 48 in the shaped upper surface 24. The recessed channels 48 are positioned in the shaped upper surface 24 in alignment with blade 26 when the anvil 20 is rotated to a 45 degree angle between the plane of the blade 26 and the reference plane of the anvil 20. In operation, as the blade 26 cuts the drywall bead 46 the sharpened edge 28 of the blade 26 passes into the recessed channels 48. By passing into the recessed channels 48 the sharpened edge 28 of the blade 26 is not dulled by contacting the anvil 20.

In an alternative embodiment, the anvil 20 does not have recessed channels 48 and the sharpened edge 28 of the blade 26 cuts the drywall bead 46 by pressing against the shaped surface 24 of the anvil 20. In another embodiment, the recessed channels 48 may only extend along a portion of the shaped surface 24. In this embodiment the sharpened edge 28 of the blade 26 will pass into the recessed channels 48 along a portion of shaped surface 24. In the remaining portion of shaped surface 24, the sharpened edge 28 of the blade 26 cuts the drywall bead 46 by pressing against the shaped surface 24 of the anvil 20. In another embodiment, the blade 26 does not completely cut through the drywall bead 46, but scores the material so that the drywall bead 46 may be broken by hand at the desired location. In another embodiment, the drywall bead is cut at angles other than 45 degrees and additional recessed channels 48 are included in the shaped surface 24 at angles other than 45 degrees relative to the plane of blade 26, such as 15 degrees, 30 degrees and other angles therebetween. A recessed channel 48 is also included at 0 degrees or perpendicular to the drywall bead 46 for making straight cuts.

As further shown in FIG. 3, pawl 50 is inserted into pivoting handle 16 and secured by pawl screw 52. The pawl screw 52 passes through hole 54 in pivoting handle 16 and through pawl 50 and is secured with nut 56. Stop pawl 60 is inserted into the base 12 and secured by stop pawl screw 62. The stop pawl screw 62 passes through hole 64 in the base 12 and through stop pawl 60 and is secured with nut 66. Both pawl 50 and stop pawl 60 are free to rotate about screws 52 and 62 respectively.

Figure 4:
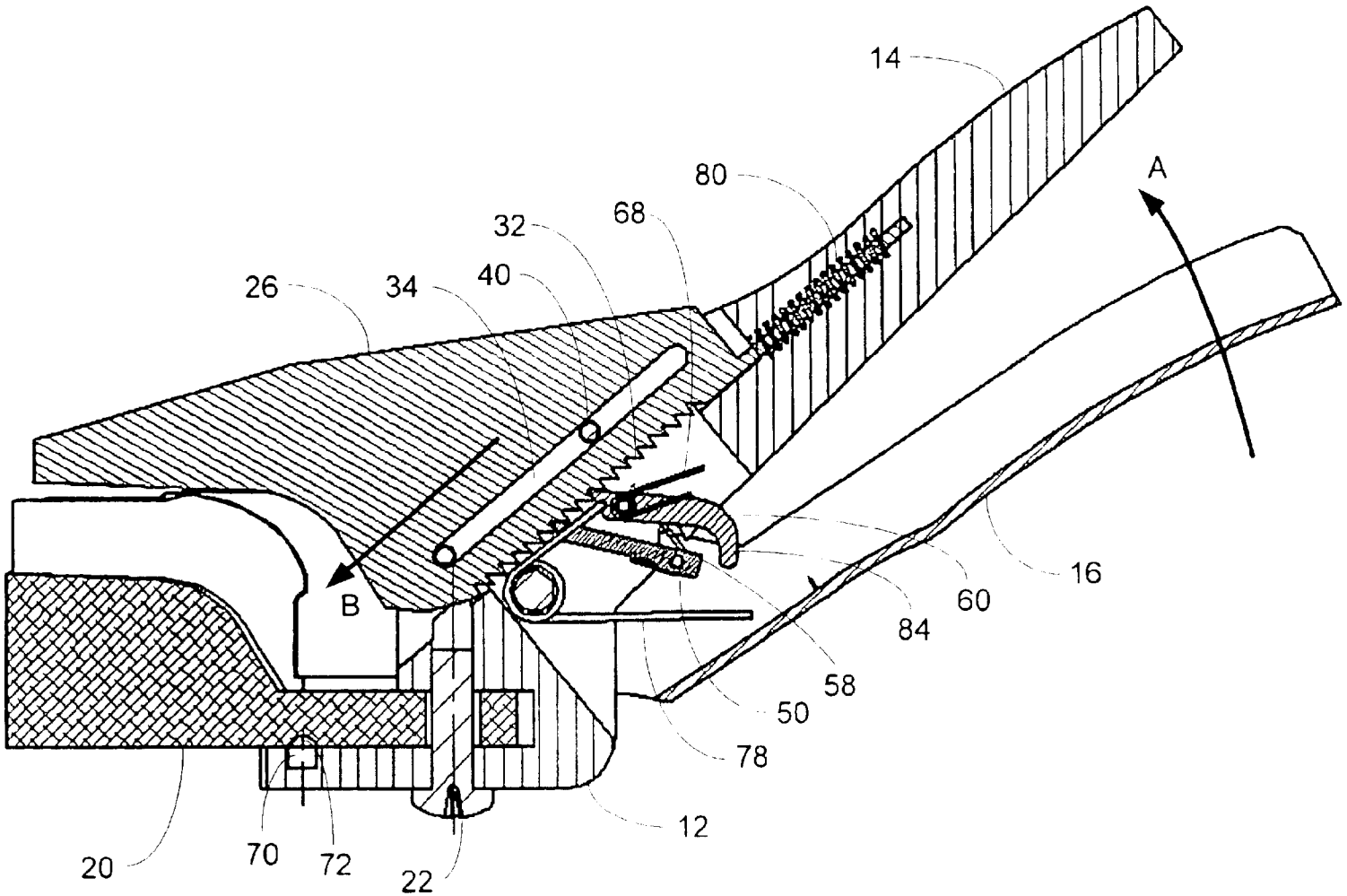
FIG. 4 is a side-cross sectional view of the tool of FIG. 1, illustrating the internal components of the tool in operation.

FIG. 4 is a side cross sectional view of the drywall bead press 10. As shown in FIG. 4, the anvil 20 is restrained in a chosen angular orientation by anvil lock bead 70. The anvil 20 may be rotated about screw 22 to an angle relative to the blade 26. As the anvil 20 is rotated from one angular position to another the lock bead 70 slides along the bottom of the anvil 20 until it rests in a lock bead recess 72. The lock bead 70 and lock bead recess 72 ensure alignment of the blade 26 with the recessed channel 48 when making a cut. In an alternative embodiment, the drywall bead is cut at angles other than 45 degrees and multiple lock bead recesses 72 are included in the anvil 20 at positions other than 45 degrees relative to the blade 26, such as 0 degrees, 15 degrees, 30 degrees and other angles therebetween.

As further shown in FIG. 4, pawl 50 is held in contact with the toothed edge 32 of the blade 26 by pawl torsion spring 58. The stop pawl 60 is also held in contact with the toothed edge 32 of the blade 26 by stop pawl torsion spring 68. The pivoting handle 16 is urged to an open position by handle torsion spring 78. The blade 26 is urged to a retracted position away from anvil 20 and into the base 12 by compression spring 80.

In operation, as the pivoting handle 16 is biased towards the fixed handle 14 in the direction of Vector A, pawl 50 is forced into toothed edge 32 of the blade 26. As pressure is further applied to pivoting handle 16, the blade 26 is forced out of the base 12 and towards the anvil 20 in the direction of Vector B. The movement of the blade 26 is restrained by guide channel 30, as best shown in FIG. 3, and stabilizer screws 40 running in slot 34. The blade 26 moves linearly out of the base 12 and towards the anvil 20. When the pressure is released on the pivoting handle 16, stop pawl 60 engages the toothed edge 32 of the blade 26 and prevents retraction of the blade 26 into the base 12. As the pivoting handle 16 is biased away from the fixed handle 14 by handle torsion spring 78, the pawl 50 ratchets down the toothed edge 32 until the pivoting handle is fully released. Since the blade 26 has been forced out of the base 12, the pawl 50 will engage a new tooth farther up the toothed edge 32 than the tooth engaged in the previous position. The toothed edge 32 functions as a rack for the engagement of the pawl 50 and together the components form a rack and pawl assembly as is commonly known in the art.

During a drywall bead cut, the pivoting handle 16 is repeatedly biased towards the fixed handle 14, the blade 26 is forced out of the base 12 and toward the anvil 20 with great force. A length of drywall bead positioned upon the anvil 20 is then cut by the advancing blade 26. After the cut is completed, the blade 26 may be retracted by applying pressure to the rear portion 84 of the stop pawl 60. Pressure applied to the rear portion 84 of the stop pawl 60 will cause the stop pawl 60 to pivot away from toothed edge 32. As the stop pawl 60 pivots the stop pawl 60 also contacts the pawl 50 and forces the pawl 50 to disengage from the toothed edge 32 of the blade 26. The blade 26 is then urged to a retracted positioned by compression spring 80 acting upon the fixed handle 14 and the upper portion of blade 26.

Figure 5:
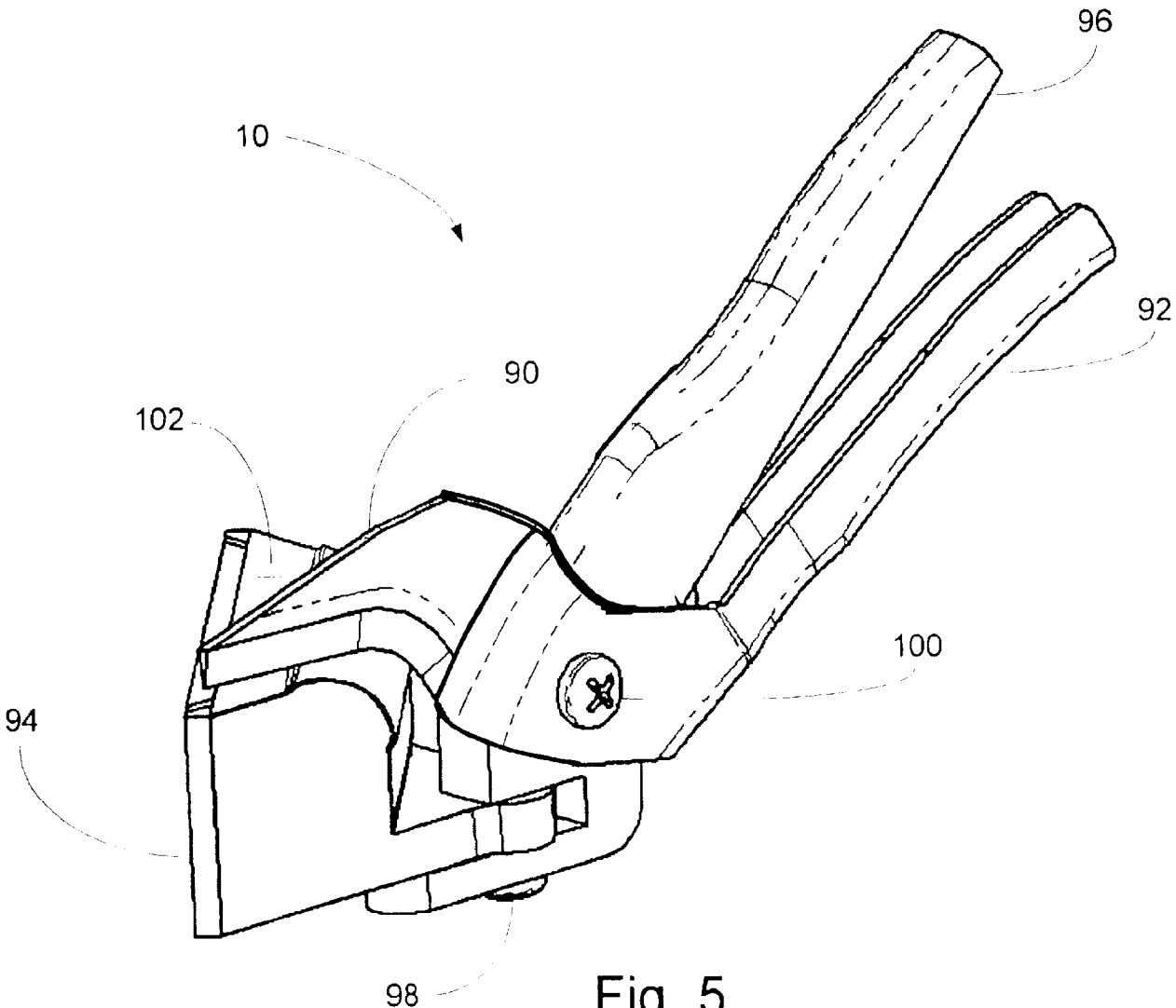
FIG. 5 is a side-perspective view of an alternative embodiment of the drywall bead press.

FIG. 5 shows an alternative embodiment of the drywall bead press 10 that may be used to practice the present invention. As shown in FIG. 5, a blade 90 is directly attached to a pivoting handle 92 and the anvil 94 is pivotably attached to a fixed handle 96 by a pivot screw 98. In this configuration, the effective fulcrum length of the fixed handle 96 and pivoting handle 92 is substantially longer than the effective fulcrum length of the blade 90 and anvil 94 about handle pivot screw 100. The mechanical advantage provided by the longer fulcrum of the pivoting handle 92 and fixed handle 96 produces sufficient force to cut a length of drywall bead positioned upon the shaped upper surface 102 of the anvil 94. In this configuration, the fixed handle 96, pivoting handle 92, blade 90 and anvil 94 form a scissor linkage as is commonly known in the art. As will be appreciated by one skilled in the art, other mechanical linkage configurations are possible which provide sufficient force to cut the drywall bead.

While there has been shown a preferred embodiment of the present invention, those skilled in the art will appreciate that certain changes may be made in the forms and arrangement of the elements for a drywall bead press without departing from the underlying spirit and scope of the invention defined by the following claims.

What is claimed is:

1. A tool for cutting drywall bead, the drywall bead having a shaped cross section and requiring cutting, the tool comprising:

a base having a first handle attached thereto;

a second handle pivotably engaging the base such that the handle is rotatable relative to the base;

a blade engaging the base and movable relative thereto, the blade having a cutting edge thereon;

an anvil pivotally attached to the base and rotatable to an angle relative to the blade, the anvil having a shaped surface thereon suitable for complimentarily engaging the shaped cross section of the drywall bead; and a mechanical linkage forcing the cutting edge of the blade towards the anvil by biasing the second handle towards the first handle such that a section of drywall bead positioned upon the shaped surface of the anvil is cut by the blade at an angle.

2. The tool of claim 1, wherein the drywall bead is cut at a 45 degree angle across the shaped cross section.

3. The tool of claim 1, wherein the cutting blade is replaceable.

4. The tool of claim 1, wherein the blade slideably engages the base such that biasing the second handle toward the first handle forces the cutting edge of the blade to move linearly towards the anvil.

5. The tool of claim 4, wherein the mechanical linkage is a rack and pawl assembly.

6. The tool of claim 4, wherein the cutting blade is replaceable.

7. The tool of claim 1, wherein the blade pivotably engages the base such that biasing the second handle towards the first handle forces the cutting edge of the blade to rotate toward the anvil.

8. The tool of claim 7, wherein the mechanical linkage is a scissor linkage.

9. The tool of claim 7, wherein the cutting blade is replaceable.

10. The tool of claim 1, wherein the shaped surface of the anvil has a recessed channel into which the cutting edge of the blade is received when the second handle is biased towards the first handle.

11. The tool of claim 10, wherein the drywall bead will be cut at a 45 degree angle across the shaped cross section.

12. The tool of claim 10, wherein the cutting blade is replaceable.

13. A method of cutting drywall bead at an angle, the drywall bead having a shaped cross section and requiring cutting, comprising the steps of:

placing the anvil of a cutting device onto a drywall bead, the anvil having a shaped surface thereon suitable for complimentarily engaging the shaped cross section of the drywall bead, the anvil pivotally attached to a base of the device such that the anvil may be rotated to a chosen angle relative to the base, the base further having a first handle rigidly attached thereto and a second handle pivotably engaged therewith such that the second handle may rotate relative to the base, the device further having a blade movably engaged with the base and including a cutting edge, and a mechanical linkage is between the second handle and the blade such that operation of the second handle forces the cutting edge of the blade towards the anvil; and cutting the section of drywall bead at an angle through biasing the second handle towards the first handle.

14. A tool for cutting drywall bead, the drywall bead having a shaped cross section and requiring cutting, the tool comprising:

a base having a first handle attached thereto;

a second handle pivotably engaging the base such that the handle is rotatable relative to the base;

a blade engaging the base such that the blade is movable relative to the base, the blade having a cutting edge thereon;

an anvil pivotally attached to the base such that the anvil is rotatable to an angle relative to the blade, the anvil having a shaped surface thereon, the shaped surface suitable for complimentarily engaging the shaped cross section of the drywall bead; and a means for forcing the cutting edge of the blade towards the anvil by biasing the second handle towards the first handle such that a section of drywall bead positioned upon the shaped surface of the anvil is cut by the blade at the chosen angle.

15. A tool for cutting drywall bead, the drywall bead having a shaped cross section and requiring cutting, the tool comprising:

a base having a first handle attached thereto;

a second handle pivotably engaging the base such that the handle is rotatable relative to the base;

a blade slideably engaging the base such that the blade is movable linearly relative to the base, the blade having a cutting edge thereon;

an anvil pivotally attached to the base and rotatable to an angle relative to the blade, the anvil having a shaped surface thereon suitable for complimentarily engaging the shaped cross section of the drywall bead, the shaped surface of the anvil having a recessed channel; and a rack and paw assembly forcing the cutting edge of the blade towards the anvil by biasing the second handle toward the first handle, and the cutting edge of the blade is received into the recessed channel of the shaped surface of the anvil such that a section of drywall bead positioned upon the shaped surface of the anvil is cut by the blade at an angle.

16. The tool of claim 15, wherein the drywall bead is cut at a 45 degree angle across the shaped cross section.

* * * * *